US005667006A

United States Patent [19]

Kang et al.

[11] Patent Number: 5,667,006

[45] Date of Patent: Sep. 16, 1997

[54] FIN TUBE HEAT EXCHANGER

[75] Inventors: Tae Wook Kang; Kam Gyu Lee, both of Busan, Rep. of Korea

[73] Assignee: LG Electronics, Inc., Seoul, Rep. of Korea

[21] Appl. No.: 590,319

[22] Filed: Jan. 23, 1996

[30] Foreign Application Priority Data

Jan. 23, 1995 [KR] Rep. of Korea ..... 1995-1076

[51] Int. Cl.[6] ..... F28F 1/32

[52] U.S. Cl. ..... 165/151; 165/182; 165/DIG. 502; 165/DIG. 504

[58] Field of Search ..... 165/151, DIG. 504, 165/DIG. 502, 182

[56] References Cited

U.S. PATENT DOCUMENTS

| | | | |
|---|---|---|---|
| 855,373 | 9/1907 | Wilson, Jr. | 165/151 |
| 1,553,093 | 9/1925 | Modine | 165/151 |
| 4,923,002 | 5/1990 | Haussmann | 165/151 |
| 5,042,576 | 8/1991 | Broadbent | 165/151 |
| 5,109,919 | 5/1992 | Sakuma et al. | 165/151 |

FOREIGN PATENT DOCUMENTS

| | | | |
|---|---|---|---|
| V 8380 X | 7/1956 | Germany | 165/151 |
| 57-144893 | 9/1982 | Japan | 165/151 |
| 62-206384 | 9/1987 | Japan | 165/151 |
| 63-201496 | 8/1988 | Japan | 165/151 |
| 5-164489 | 6/1993 | Japan | 165/151 |

*Primary Examiner*—Allen J. Flanigan

*Attorney, Agent, or Firm*—Birch, Stewart, Kolasch & Birch, LLP

[57] ABSTRACT

A fin tube heat exchanger includes a plurality of fin plates disposed in parallel with one another, spaced at regular intervals and adapted to allow air to flow therebetween, and a plurality of refrigerant tubes disposed in at least two rows, inserted into the fin plates in a perpendicular direction and being adapted to allow a fluid medium to pass therein. Each of the fin plates has a plurality of raised strips which extend in a direction perpendicular to a direction of air flow. A plurality of normal raised strips are formed on both sides of the fin plates in at least one row on an air flow outlet side. A plurality of low raised strips or embossings are formed on at least one side of the fin plates in other rows. The height of the low raised strips or embossings in the other rows are lower than the height of the normal raised strips in the at least one row.

3 Claims, 7 Drawing Sheets

FIN TUBE HEAT EXCHANGER

BACKGROUND OF THE INVENTION

The present invention relates to a fin tube heat exchanger, and more particularly to a fin tube heat exchanger for reducing noise due to airflow resistance and increasing heat transfer performance by draining water drops generated on the fin surface smoothly.

Generally, as shown in FIG. 1, a fin tube heat exchanger 1 is provided with a plurality of fin plates 2 of aluminum spaced at regular intervals and a plurality of refrigerant tubes 3 extending through the fin plates 2. The refrigerant tubes 3 extend through the fin collars 4 and are enlarged so as to be rigidly secured therein. Each fin plate 2 has a plurality of narrow raised strips extending across the direction of flow. These strips are raised from the plane in which the fin plate 2 lies for raising the heat exchanging performance.

FIGS. 2 to 4 show conventional configurations of raised strips.

As shown in FIG. 2A, raised strips 5, 6, 7, 8 or 5, 6', 7, 8' extend in a direction perpendicular to the direction of air flow shown by arrows A and B. The raised strips 5, 6, 7, 8 are formed on the same side of each fin plate 2 in FIG. 2B whereas the raised strips 5, 6', 7, 8' are formed alternately on both sides of each fin plate 2 in FIG. 2C.

Raised strips shown in FIG. 3A also extend in a direction perpendicular to the direction of air flow shown by arrows A and B. The raised strips 9, 10, 11, 12, 13, 14 in FIG. 3B are formed on the same side of each fin plate 2 whereas the raised strips 9, 10', 11, 12', 13, 14' in FIG. 3C are formed alternately on both sides of each fin plate 2.

In the case of the raised strips 5, 6, 7, 8 as shown in FIG. 2B, water drops tend to stay between adjacent raised strips 5, 6, 7, 8. On the other hand, in the case of the raised strips 5, 6', 7, 8' as shown in FIG. 2C, water drops tend to stay substantially in the form of a bridge between adjacent raised strips 5, 6', 7, 8'. In either case, water drops do not drop from the fin plate until they grow into a considerable size, thereby generating noise due to airflow resistance.

In FIGS. 3B and 3C, water drops also tend to stay between adjacent raised strips 9, 10, 11, 12, 13, 14 or 9, 10', 11, 12', 13, 14' in the same manner as described above. In this case, since each fin plate 2 is provided with a draining passage 15 along the center line of a row of refrigerant tubes 3, not as many water drops remain as compared with the strip pattern as shown in FIGS. 2A to 2C, but the heat exchanging performance is still lowered.

FIG. 4 shows another conventional configuration of raised strips disclosed in Japanese Patent Laid-open Publication No. 2-171596.

As shown in FIGS. 4A and 4B, raised strips 21*a*, 21*b*, 21*c*, 23, 25*a*, 25*b* are formed on the same side of fin plate 2 by one punch on the side of air flow inlet. Raised strips 22*a*, 22*b*, 24, 26*a*, 26*b*, 26*c* formed in the opposite direction by another punch are formed alternately on an opposite side of the fin plate 2 simultaneously on the side of air flow outlet in addition to above-mentioned raised strips 21*a*, 21*b*, 21*c*, 23, 25*a*, 25*b*. In this case, however, water drops are generated at the raised strips 21*a*, 21*b*, 21*c*, 23, 25*a*, 25*b* on the side of air flow inlet, and the heat exchanging performance is lowered at the fin plate portion on the side of air flow inlet where the raised strips 22*a*, 22*b*, 24, 26*a*, 26*b*, 26*c* are not formed.

SUMMARY OF THE INVENTION

It is an object of the present invention to provide a fin tube heat exchanger for reducing airflow resistance, reducing noise and increasing heat exchanging performance when used as an evaporator.

In order to achieve the above-mentioned object, the fin tube heat exchanger according to the present invention includes a plurality of fin plates disposed in parallel with one another, spaced at regular intervals and adapted to allow air to flow therebetween, and a plurality of refrigerant tubes disposed in at least two rows, inserted into the fin plates in a perpendicular direction and being adapted to allow a fluid medium to pass therein. Each of the fin plates has a plurality of raised strips which extend in a direction perpendicular to a direction of air flow. A plurality of normal raised strips are formed on both sides of the fin plates in at least one row on an air flow outlet side. A plurality of low raised strips are formed on at least one side of the fin plates in other rows. The height of the low raised strips in the other rows are lower than the height of the normal raised strips in the at least one row.

According to another aspect of the present invention, the low raised strips are formed on both sides of the fin plates in the other rows.

According to a further aspect of the present invention, the normal raised strips are formed in the other rows on a side opposite to the at least one side on which the low raised strips are formed.

According to still a further aspect of the present invention, a plurality of low embossings are formed instead of a plurality of the low raised strips.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENT

Figure 5A:
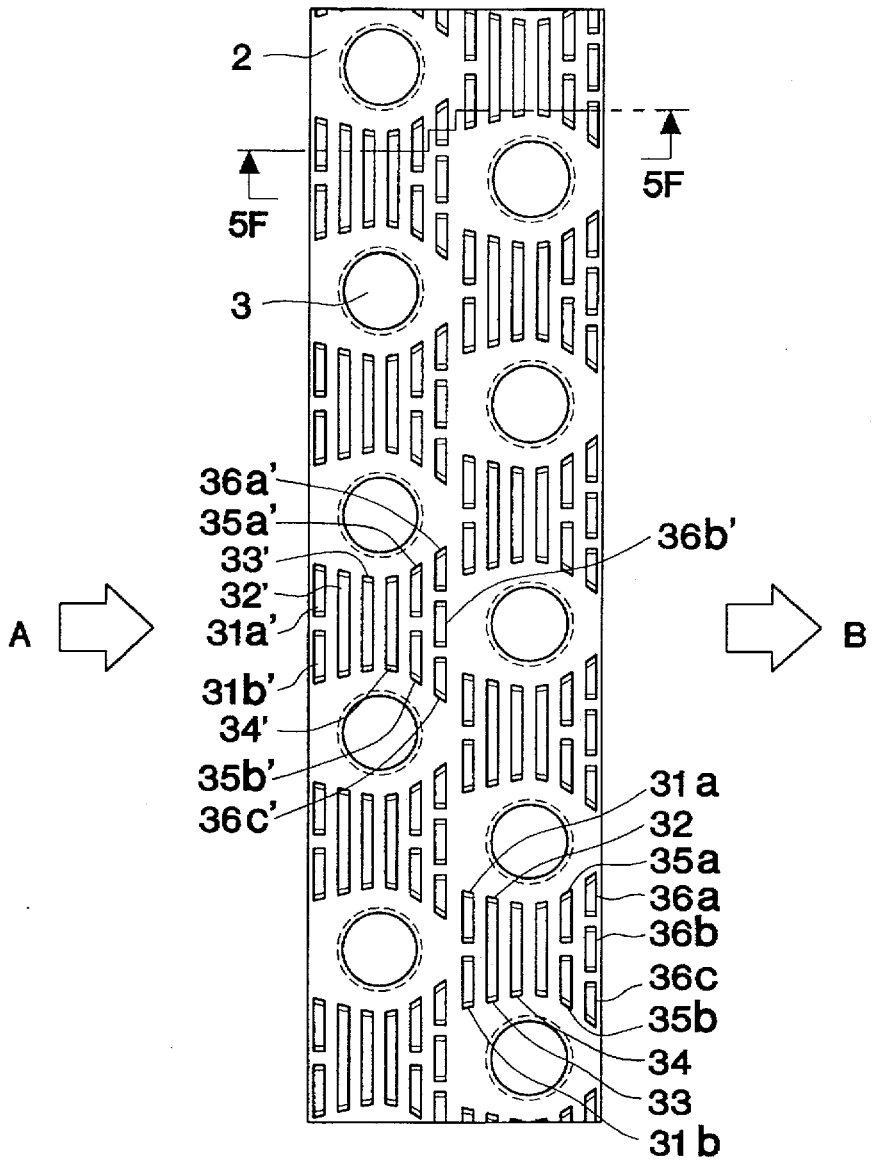
FIG. 5A is a front view of a fin plate according to a first embodiment of the present invention.
Figure 5B:
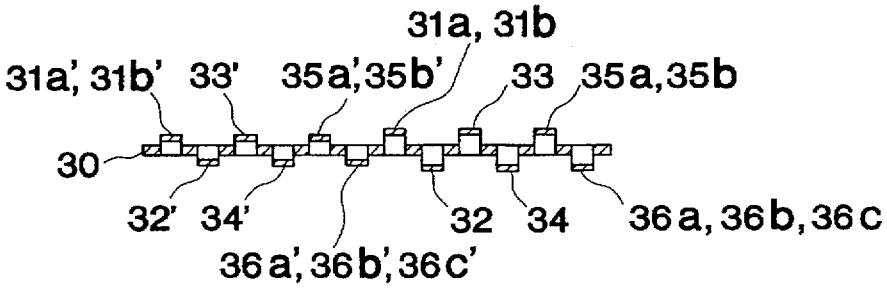
FIG. 5B is a sectional view taken along the line 5F—5F in FIG. 5A.

FIGS. 5A and 5B show a fin plate mounted in a fin tube heat exchanger according to a first embodiment of the present invention.

As shown in FIG. 5A, two rows of raised strips 31*a'*–31*b'*, 32', 33', 34', 35*a'*–35*b'*, 36*a'*–36*c'* and 31*a*–31*b*, 32, 33, 34, 35*a*–35*b*, 36*a*–36*c* extend in a direction perpendicular to the direction of air flow shown by arrows A and B. In addition, as shown in FIG. 5B, aforementioned raised strips are formed alternately on both sides of fin base surface 30.

The height of the raised strips 31*a'*–31*b'*, 32', 33', 34', 35*a'*–35*b'*, 36*a'*–36*c'*, formed on the side of air flow inlet, are lower than that of the raised strips 31*a*–31*b*, 32, 33, 34, 35*a*–35*b*, 36*a*–36*c* formed on the side of air flow outlet. That is, in the air flow inlet side row where a lot of water drops are generated according to refrigerant cycle, the raised strips 31*a'*–31*b'*, 32', 33', 34', 35*a'*–35*b'*, 36*a'*–36*c'*, whose height is low, are formed.

Figure 1:
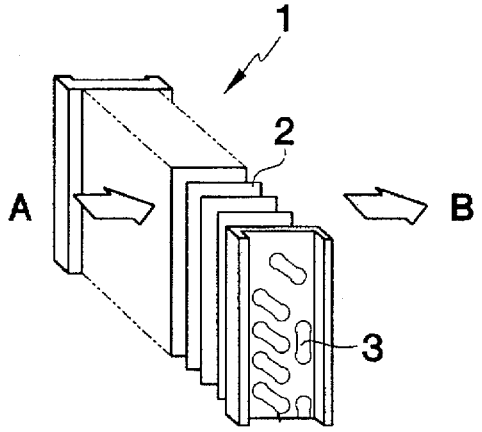
FIG. 1 PRIOR ART
FIG. 1 is a perspective view of a conventional fin tube heat exchanger.
Figure 2A:
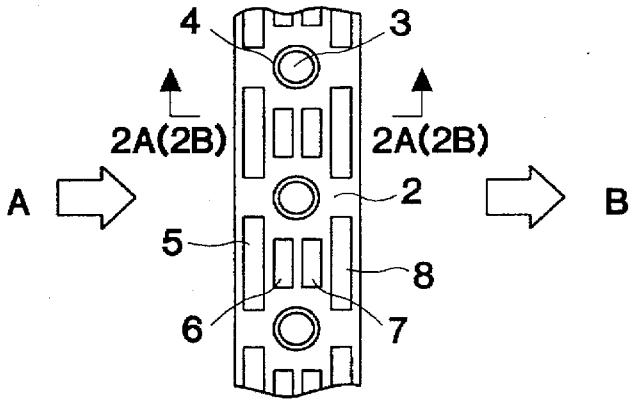
FIG. 2A PRIOR ART
FIG. 2A is a front view of a conventional fin plate mounted in the heat exchanger of FIG. 1.
Figure 2B:
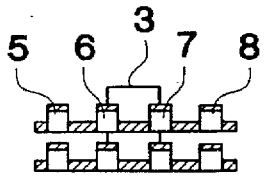
FIG. 2B PRIOR ART
FIGS. 2B and 2C are sectional views taken along the lines 2A—2A and 2B—2B in FIG. 2A, respectively.
Figure 2C:
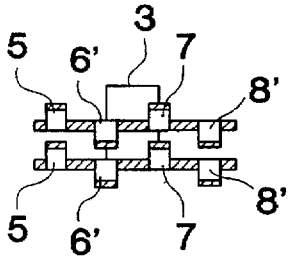
FIG. 2C PRIOR ART
Figure 3A:
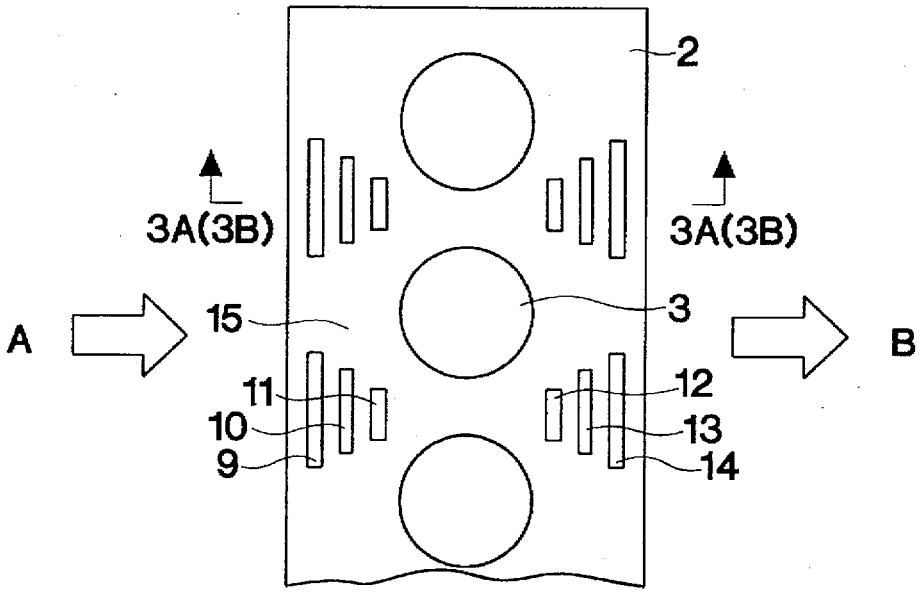
FIG. 3A PRIOR ART
FIG. 3A is a front view of another conventional fin plate.
Figure 3B:
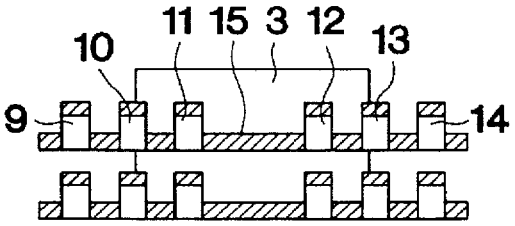
FIG. 3B PRIOR ART
FIGS. 3B and 3C are sectional views taken along the lines 3A—3A and 3B—3B in FIG. 3A, respectively.
Figure 3C:
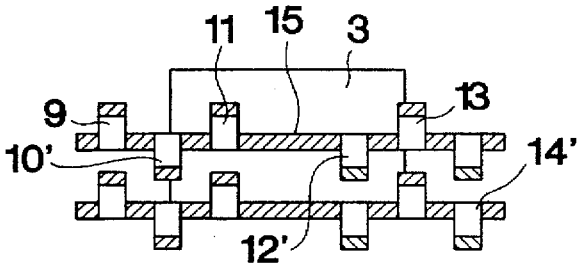
FIG. 3C PRIOR ART
Figure 4A:
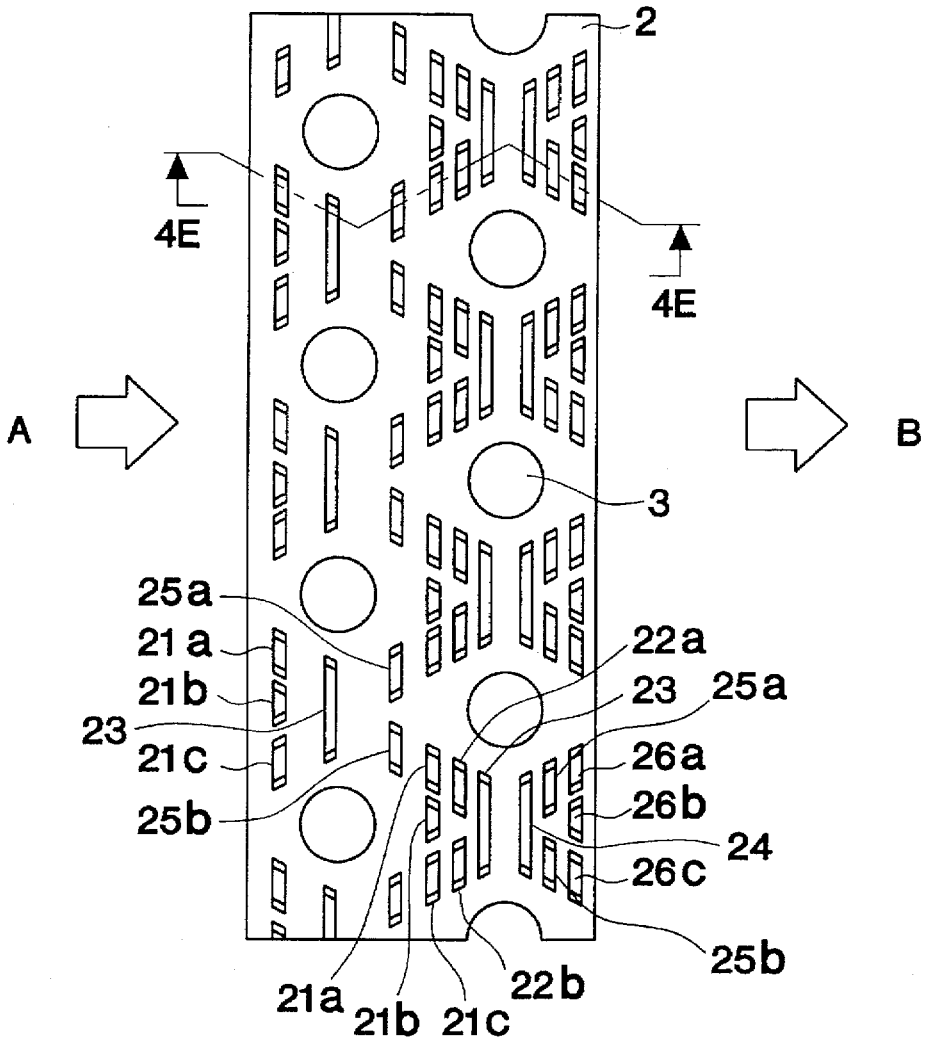
Fig. 4A PRIOR ART
FIG. 4A is a front view of a further conventional fin plate.
Figure 4B:
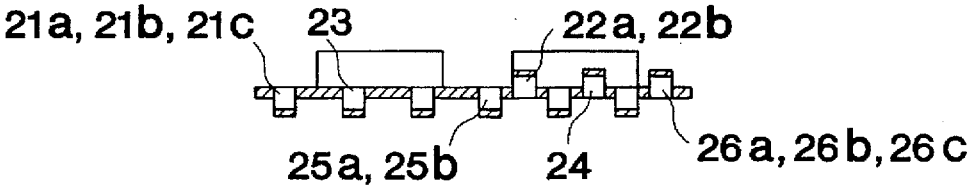
FIG. 4B PRIOR ART
FIG. 4B is a sectional view taken along the line 4E—4E in FIG. 4A.

When the heat exchanger mounting aforementioned fin plate is used as an evaporator, since the height of the raised strips 31*a'*–31*b'*, 32', 33', 34', 35*a'*–35*b'*, 36*a'*–36*c'* is low, the size of water drops, which are generated between the raised strips 31*a'*–31*b'*, 32', 33', 34', 35*a'*–35*b'*, 36*a'*–36*c'* and fin base 30, is small. Namely, water drops do not stay in the form of a bridge between adjacent raised strips in contrast with the raised strips formed alternately on both sides of fin plate shown in FIGS. 2C and 3C.

In addition, ventilation space exists between the raised strips 31*a'*–31*b'*, 32', 33', 34', 35*a'*–35*b'*, 36*a'*–36*c'* whose height is low and other raised strips of adjacent fin plates whose height is low, so that airflow resistance is lowered and heat transfer performance is increased.

On the other hand, in the air flow outlet side row raised strips 31*a*–31*b*, 32, 33, 34, 35*a*–35*b*, 36*a*–36*c*, whose height is normal, are formed in contrast with the air flow inlet side row where water drops are generated intensively. Accordingly, since air flow passes between the raised strips 31*a*–31*b*, 32, 33, 34, 35*a*–35*b*, 36*a*–36*c*, and the fin base 30, the heat exchanging performance is improved by the so-called boundary layer front-edge effect.

Figure 6:
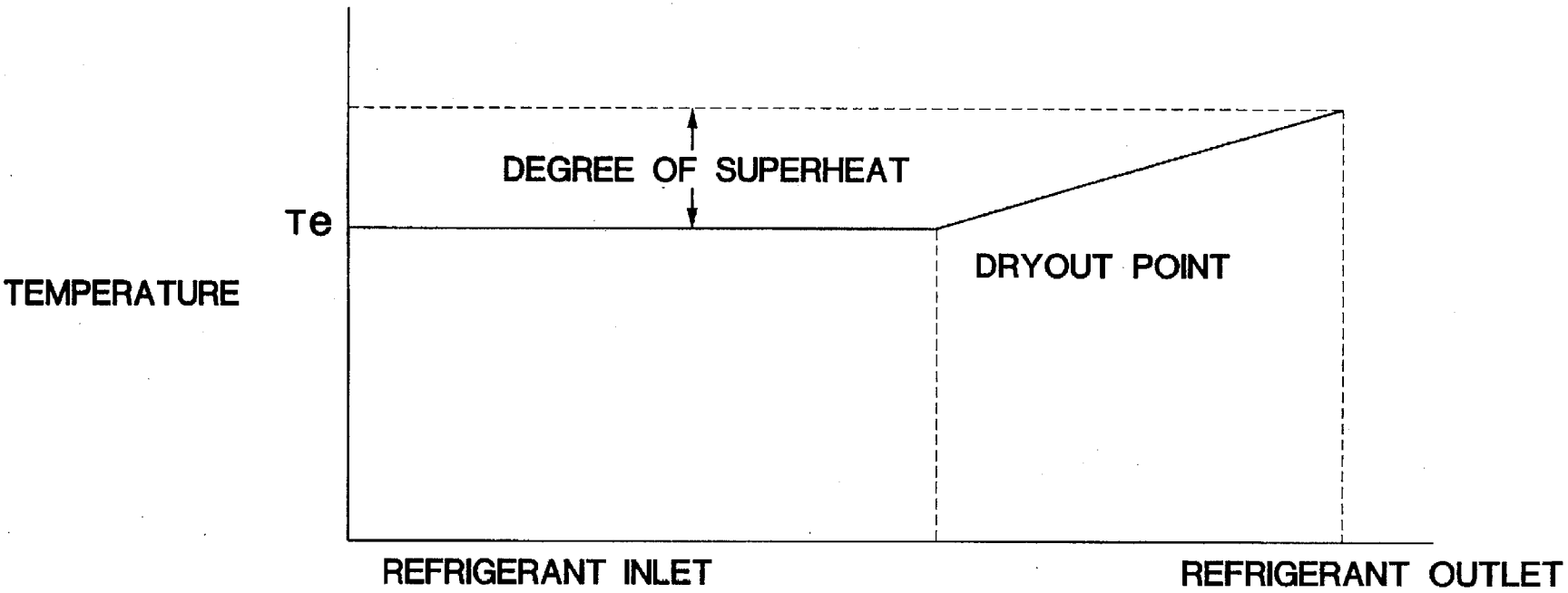
FIG. 6 is a graph showing the surface temperature of the refrigerant tube at the refrigerant inlet and refrigerant outlet of an evaporator.

FIG. 6 shows the surface temperature of the refrigerant tube at the refrigerant inlet and refrigerant outlet of an evaporator. Low temperature refrigerant flows in from the refrigerant inlet, the surface temperature is maintained at a constant temperature (evaporation temperature: Te) while dryness of the refrigerant changes along the refrigerant tube, and the temperature of the refrigerant (that is, the surface temperature of the refrigerant tube) begins to increase from a dryout point where the evaporation of the refrigerant is completed.

Accordingly, since the difference of temperature between the surface temperature of the refrigerant tube and the temperature of the air which passes through the heat exchanger is large in the low-temperature portion of the refrigerant tube, a lot of water drops are generated on the fin plates inserted in the refrigerant tube in a perpendicular direction.

On the other hand, in the outlet portion of the refrigerant tube whose temperature is relatively high, the surface temperature of the refrigerant tube is over the dew point temperature of the air which passes through the heat exchanger, so that water drops are not generated or very tiny water drops are generated.

Accordingly, in the refrigerant outlet, the fin plate having normal raised strips 31*a*–31*b*, 32, 33, 34, 35*a*–35*b*, 36*a*–36*c* is attached whereas the fin plate having the raised strips 31*a'*–31*b'*, 32', 33', 34', 35*a'*–35*b'*, 36*a'*–36*c'* whose height is low, is attached in the refrigerant inlet where there is a great difference of the temperature between the surface of the refrigerant tube and the air.

Figure 7A:
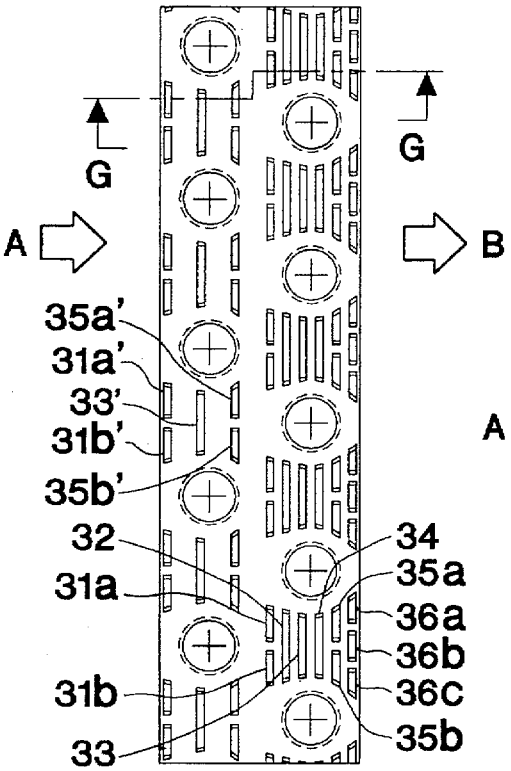
FIG. 7A is a front view of a fin plate according to a second embodiment of the present invention.

FIG. 7 shows a fin plate mounted in a fin tube heat exchanger according to a second embodiment of the present invention.

Figure 7B:
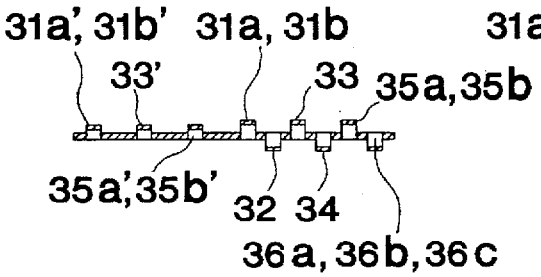
FIG. 7B is a sectional view taken along the line G—G in FIG. 7A.

As shown in FIG. 7B, the strip pattern in the air flow outlet side row of the fin plate in this embodiment is identical with that in the first embodiment. On the other hand, in the air flow inlet side row there are formed one raised strip 33' substantially at the center of the fin plate, two raised strips 31*a'*, 31*b'* on the upstream side thereof and two raised strips 35*a'*, 35*b'* on the downstream side thereof. The first, second and third rows of strips of the second embodiment correspond to the first, third and fifth rows of strips of the first embodiment, respectively. That is, three rows of raised strips 31*a'*, 31*b'*, 33', 35*a'*, 35*b'* formed by one punch among the low raised strips 31*a'*–31*b'*, 32', 33', 34', 35*a'*–35*b'*, 36*a'*–36*c'* of the first embodiment are formed on one side of the fin plate.

Figure 8A:
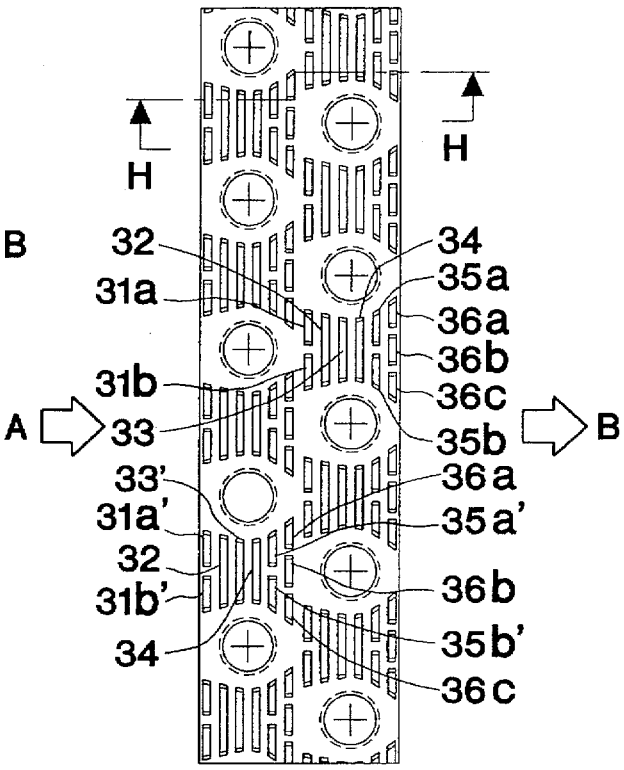
FIG. 8A is a front view of a fin plate according to a third embodiment of the present invention.

FIG. 8 shows a fin plate mounted in a fin tube heat exchanger according to a third embodiment of the present invention.

Figure 8B:
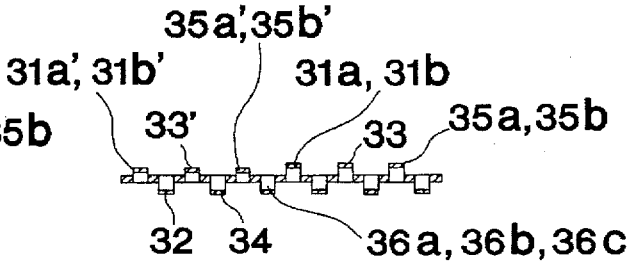
FIG. 8B is a sectional view taken along the line H—H in FIG. 8A.

As shown in FIG. 8B, the strip pattern in the air flow outlet side row of the fin plate in this embodiment is identical with that in the first embodiment. On the other hand, low raised strips 31*a'*, 31*b'*, 33', 35*a'*, 35*b'* whose strip pattern is identical with that in the second embodiment, are formed by one punch on one side of the fin plate in the air flow inlet side row, and the raised strips 32, 34, 36*a*, 36*b*, 36*c* formed on one side of the fin plate in the air flow outlet side row, are formed by another punch on the opposite side of the fin plate in the air flow inlet side row.

Figure 9A:
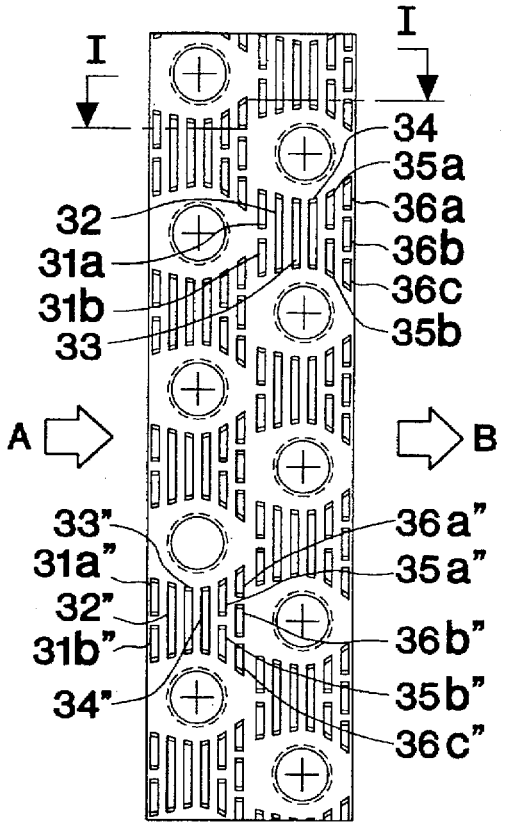
FIG. 9A is a front view of a fin plate according to a fourth embodiment of the present invention.
Figure 10A:
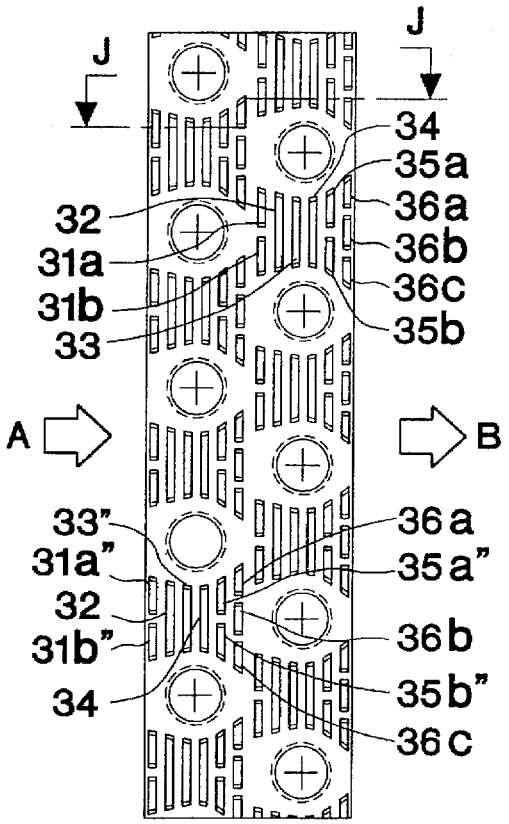
FIG. 10A is a front view of a fin plate according to a fifth embodiment of the present invention.
Figure 9B:
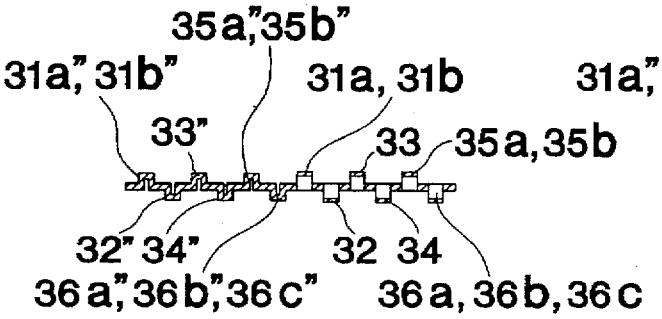
FIG. 9B is a sectional view taken along the line I—I in FIG. 9A.
Figure 10B:
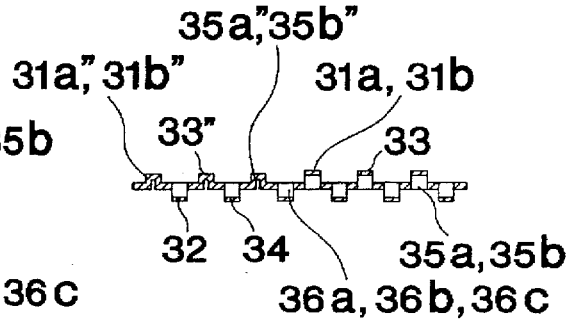
FIG. 10B is a sectional view taken along the line J—J in FIG. 10A.

FIGS. 9 and 10 show a fin plate mounted in a fin tube heat exchanger according to a fourth and a fifth embodiment of the present invention, respectively.

The strip pattern in the fourth embodiment is identical with that in the first embodiment except that embossings 31*a*"–31*b*", 32", 33", 34", 35*a*"–35*b*", 36*a*"–36*c*" whose height is low and whose shape is similar to above-described raised strips 31*a'*–31*b'*, 32', 33', 34', 35*a'*–35*b'*, 36*a'*–36*c'* are formed instead of the raised strips 31*a'*–31*b'*, 32', 33', 34', 35*a'*–35*b'*, 36*a'*–36*c'*whose height is low.

The strip pattern in the fifth embodiment is identical with that in the third embodiment except that embossings 31*a*"–31*b*", 33", 35*a*"–35*b*" whose height is low and whose shape is similar to aforementioned raised strips 31*a'*–31*b'*, 33', 35*a'*–35*b'* whose height is low.

Aforementioned low raised strips and embossings can be formed by stroke control of the punch.

In accordance with the fin tube heat exchanger of the present invention, the reduction of the heat transfer performance due to water drops is prevented by lowering the height of the raised strips or embossings formed in the rows where a lot of water drops are generated.

In addition, the heat exchanging performance is improved by the raised strips or embossings whose height is low and noise can be reduced due to the decrease of airflow resistance.

While specific embodiments of the invention have been illustrated and described wherein, it is to realize that modifications and changes will occur to those skilled in the art. It is therefore to be understood that the appended claims are intended to cover all modifications and changes as fall within the true spirit and scope of the invention.

What is claimed is:

1. A fin tube heat exchanger comprising:

a plurality of fin plates disposed in parallel with one another, spaced at regular intervals and adapted to allow air to flow therebetween; and a plurality of refrigerant tubes disposed in at least two rows, inserted into the fin plates in a perpendicular direction and being adapted to allow a fluid medium to pass therein;

each of said fin plates having a plurality of raised strips which extend in a direction perpendicular to a direction of air flow, a plurality of normal raised strips being formed on both sides of said fin plates in at least one row on an air flow outlet side, and a plurality of non-piercing embossings being formed on at least one side of said fin plates in other rows, said embossings protruding from a surface of the fin plate without piercing the fin plate, the height of said embossings in said other rows being lower than the height of said normal raised strips in said at least one row.

2. A fin tube heat exchanger according to claim 1, wherein said embossings are formed on both sides of said fin plates in said other rows.

3. A fin tube heat exchanger according to claim 1, wherein said normal raised strips are formed in said other rows on a side opposite to said at least one side on which said embossings are formed.

* * * * *